United States Patent [19]

Moir

[11] Patent Number: 4,619,594

[45] Date of Patent: Oct. 28, 1986

[54] STACKABLE ROTARY VANE PUMP WITH IMPROVED VOLUMETRIC EFFICIENCY

[75] Inventor: Virginia S. Moir, Elyria, Ohio

[73] Assignee: Lear Siegler, Inc., Elyria, Ohio

[21] Appl. No.: 732,940

[22] Filed: May 13, 1985

[51] Int. Cl.[4] ..... F04C 8/00; F04C 23/00

[52] U.S. Cl. ..... 418/5; 418/255; 418/259

[58] Field of Search ..... 418/261, 259, 256, 266–269, 418/3, 5, 7

[56] References Cited

U.S. PATENT DOCUMENTS 2,771,860 11/1956 Falk ..... 418/268
4,175,393 11/1979 Frank ..... 418/268

FOREIGN PATENT DOCUMENTS 684670 4/1964 Canada ..... 418/5
18544 8/1928 Netherlands ..... 418/256

*Primary Examiner*—Leonard E. Smith
*Assistant Examiner*—Jane E. Obee
*Attorney, Agent, or Firm*—Renner, Otto, Boisselle & Lyon

[57] ABSTRACT

A rotary vane pump includes a shaft of uniform diameter over at least the portion of its length passing through a cavity in a liner member which is eccentric to the shaft and a pair of end bearings defining opposite end faces of the cavity. Vanes extend from the shaft into contact with the eccentric cavity and define pumping pockets which expand and contract as the shaft rotates. The rotating shaft is mounted substantially tangent to the cavity in the liner and is journal mounted in such end bearings which seal opposite ends of the pumping pockets. The vanes are positioned axially of the shaft by means of a groove formed in one end face of the liner and corresponding tabs which project radially from each of the vanes. Alternatively, the groove may be formed by providing a separate wafer adjacent one end of the pump liner having an internal bore of a greater diameter than the internal diameter of the liner. By providing the shaft with a uniform diameter over a substantial portion of its length, multiple pumping units may be mounted on such uniform diameter portion.

28 Claims, 11 Drawing Figures

STACKABLE ROTARY VANE PUMP WITH IMPROVED VOLUMETRIC EFFICIENCY

BACKGROUND OF THE INVENTION

The present invention relates generally to rotary vane pumps and motors, and more particularly, to stackable rotary vane pumps with improved volumetric efficiency.

Rotary vane pumps and motors are used in many different applications. These devices use mechanical power to compress a fluid when operating as a pump, and can operate as a motor to supply a rotary output when provided with a compressed fluid as a power source. Used as motors, these devices have been used in aircraft in air-assist starting of turbine engines. Also, such devices have been used in aircraft applications as pumps to supply either vacuum or fluid under pressure. To avoid complication of description, these devices will be described herein as pumps, it being understood that the reverse operation as a motor is equally possible.

Typically these pumps comprise a housing including a liner with a bore and a pair of end bearings which support a rotatable shaft. The axis of the liner is parallel to and offset from the axis of the shaft. Vanes slide radially in and out in slots through the shaft and provide pockets which expand and contract with each shaft revolution. The vanes are held in engagement with the bore in the liner by centrifugal force as the shaft rotates.

Axial positioning and sealing of the axial ends of the vanes of prior art pumps has been accomplished in different ways, each with accompanying drawbacks. One technique permits maximum volumetric efficiency but limits design and construction flexibility; another technique has reduced volumetric efficiency but enhanced design flexibility. In this context, volumetric efficiency is increased when the shaft is mounted as nearly tangent to the liner bore as possible. Design flexibility is enhanced when multiple pump units can be mounted on a single shaft.

The first of these prior art techniques is to form shoulders reducing the shaft diameter at opposite ends of the liner. This permits the end bearings of the housing to overlap radially part of the shaft. Thus the end bearings serve to position the vanes axially even where the shaft and liner bore are tangent to each other and the vanes are fully inside the slot in the shaft. However, this design prohibits more than a single pump unit per shaft because the end bearings for each pump unit must be assembled from opposite ends of the shaft.

Another prior art technique for axial positioning of vanes in this type of pump utilizes a shaft of uniform diameter, which permits multiple pump units to be mounted on a single shaft. However, this is accomplished at the expense of reducing volumetric efficiency, in that in order to position the vanes axially when the pockets are at their minimum size, the shaft is mounted short of tangent to the liner bore. Thus the vanes never retract completely and the small amount of the end face of each vane which projects beyond the circumference of the shaft bears against a respective end bearing to position the vane axially. Because the shaft is not tangent to the liner bore and the vanes never retract completely into the shaft, volumetric efficiency is reduced.

SUMMARY OF THE INVENTION

The present invention provides a rotary vane pump (or motor) which can be constructed with multiple pump units on a single shaft and which has near maximum volumetric efficiency, which is particularly desirable for improved altitude performance. To these ends the shaft is formed with a uniform diameter for at least a substantial portion of its length and is mounted as near to tangent to the liner bore as is practicable. Axial positioning of the vanes is accomplished by providing each vane with a radially extending tab at one axial end thereof. The tab fits in an annular groove formed by a counterbore in the bearing liner and an end face of one of the end bearings. Alternatively, the groove may be formed by providing a separate wafer adjacent one end of each pump liner having an internal bore of a greater diameter than the internal diameter of the liner. Each of these arrangements permits the shaft to have a uniform diameter and to be mounted tangent or very nearly tangent to the bore in the liner while still allowing total control of the axial position of the vane.

The invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be embodied.

DESCRIPTION OF THE PREFERRED EMBODIMENTS

Figure 1:
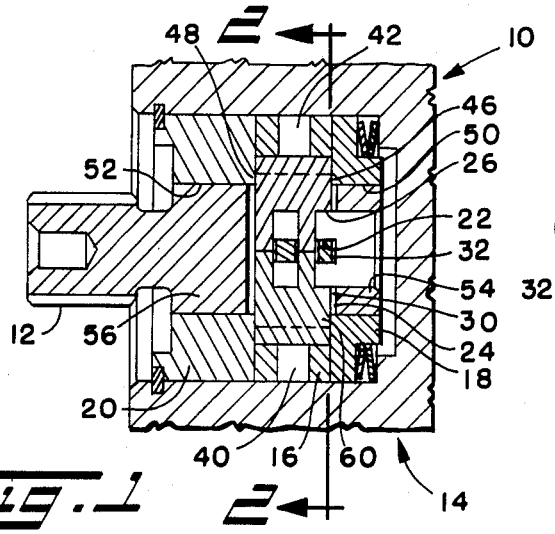
FIG. 1 PRIOR ART
FIG. 1 is a fragmentary longitudinal section through one form of prior art pump having a pair of shoulders formed on the rotatable shaft which forms a portion thereof.
Figure 2:
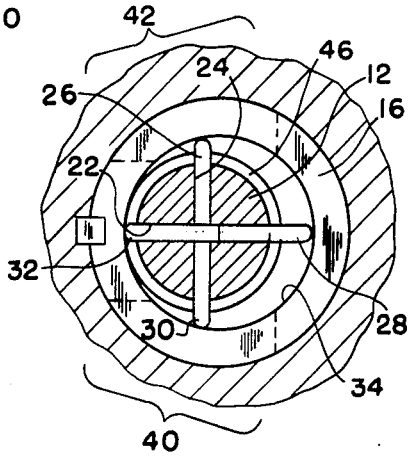
FIG. 2 PRIOR ART
FIG. 2 is a fragmentary section through the pump of FIG. 1 taken along line 2—2 thereof.

A rotary vane pump or motor assembly of conventional design is shown in FIGS. 1 and 2. As is well known in the art, rotary vane pumps may have a mechanical input and provide an output of compressed or moving fluid, or the operation may be reversed with the device being supplied with fluid under pressure as an input and providing a rotary motion as its mechanical output. In the former case the device is operating as a pump and in the latter as a motor. The term "pump" will be used in the specification and claims, it being understood that the description and claims apply equally to motors.

The pump 10 includes shaft 12 and a housing 14. The housing 14 includes a liner 16 and end bearings 18, 20. The shaft 12 is formed with slots 22 and 24 (FIG. 2) which each carry two vanes 26, 30 and 28, 32. Each of the vanes slides in and out of the slot in which it is mounted and each adjacent pair of vanes, e.g., 26 and 28, defines a pocket which expands and contracts as the shaft 12 turns.

Upon rotation of the shaft 12, the vanes 26–32 are pressed against a bore 34 formed in the liner 16 by centrifugal force, and the pockets move past ports 40 and 42 drawing fluid in from one port and expelling it through the other port. The maximum squeeze or compression of the fluid occurs when the shaft 12 is closest to the liner bore 34 and the vane there located is pressed all the way into its respective slot, e.g., vane 32 received in slot 22 in FIG. 2.

The slots 22 and 24 extend axially farther than the length of the vanes which are the same length as the axial length of the liner 16 as seen in FIG. 1. The end bearings 18 and 20 serve to position the vanes 26–32 axially within the slots. This is necessary because the shaft 12 is mounted as nearly tangent as practicable to the bore 34. The end bearings are able to do this because the shaft 12 is formed with shoulders 46 and 48 which are perpendicular to the axis of rotation of the shaft and are spaced apart a distance equal to the axial length of the liner 16. Thus, the end bearings 18 and 20 simultaneously engage the ends of the liner 16 and the shoulders 46 and 48 and permit the opposite ends of the vanes to have contact with the axial bearing faces for axial retention.

Because the shaft 12 is formed with shoulders 46 and 48, it is not possible to place more than one pumping unit on a single shaft. The end bearings 18 and 20 must be assembled onto the shaft 12 from opposite directions because the end bearings have cylindrical bearing surfaces 50 and 52, respectively, which are the same diameter as the reduced diameter portions 54 and 56, respectively, of the shaft 12. The prior art pump 10 thus cannot be stacked to position plural units on a single shaft. However, the pump 10 does permit the larger diameter portion 60 of the shaft 12 to be mounted tangent or nearly so with the bore 34 in order to produce the largest volumetric efficiency possible for a given bore diameter and diameter of the larger portion 60 of the pump shaft 12.

In this context, volumetric efficiency is directly proportional to the volume of fluid displaced per revolution of the shaft. The displacement volume is determined by stubtracting the smallest pocket volume from the largest pocket volume and multiplying by the number of pockets per revolution. The axial length of the pump can be ignored so long as pumps of the same length are being compared to each other. Since the shaft 12 is mounted tangent or nearly tangent to the liner 16, the smallest pocket volume is as small as can be practically achieved using a liner with a given bore. Accordingly, for a given pump length, liner bore diameter and shaft diameter, the pump 10 achieves the maximum volumetric efficiency possible. Factors which limit how close the shaft 12 may come to being actually tangent to the liner are primarily dynamic factors having to do with fluid viscosity and resultant fluid shear, and therefore depend on the fluid pumped and the speed of the pump.

Figure 3:
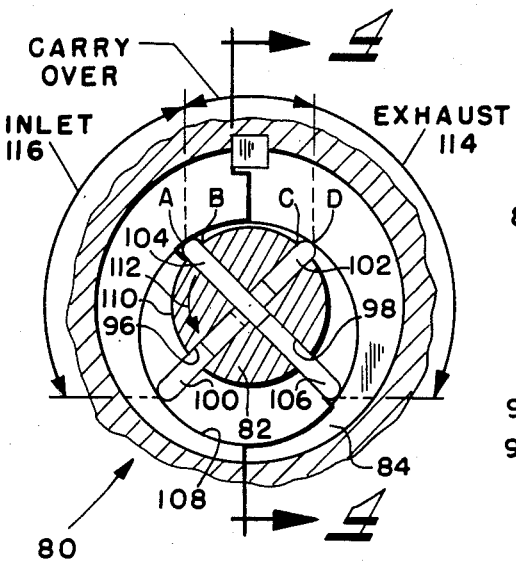
FIG. 3 PRIOR ART
FIG. 3 is a fragmentary transverse section through another form of prior art type of pump having a shaft with uniform diameter.
Figure 4:
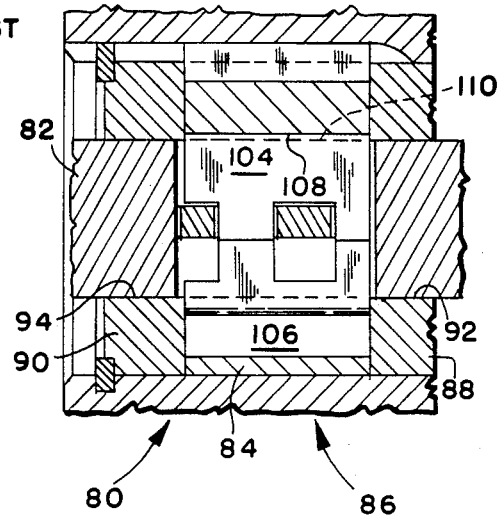
FIG. 4 PRIOR ART
FIG. 4 is a fragmentary longitudinal section of the pump of FIG. 3 taken along line 4—4 thereof.

A second prior art pump 80 is illustrated in FIGS. 3 and 4. The pump 80 is designed with a shaft 82 which has a uniform diameter throughout its length with the result that multiple pump units may be stacked on a single shaft. However, to achieve this the shaft 82 is mounted less eccentrically with respect to its liner 84 than in the embodiment shown in FIGS. 1 snd 2. Specifically, the pump 80 includes a housing 86 with liner 84 and end bearings 88 and 90. The end bearings 88 and 90 have internal cylindrical bearing surfaces 92 and 94, respectively, in which the shaft 82 is journal mounted. The shaft 82 includes slots 96 and 98 each of which carry two vanes 100, 102, and 104, 106. As in the previously described embodiment, the vanes 100–106 slide in and out to define pockets which expand and contract as the shaft 82 rotates. Centrifugal force holds the vanes against the interior surface 108 of the liner 84 when the shaft 82 rotates.

In the pump 80 the end bearings 88 and 90 again serve to retain the vanes 100–106 axially. However, this is accomplished in a slightly different manner from the prior art pump illustrated in FIGS. 1 and 2. As noted above, the shaft 82 is mounted less eccentrically of the interior surface 108 of the liner 84 than in the previous embodiment. This has the result that even when a vane is radially innermost of the shaft 82, e.g., when a vane extends vertically upwardly as viewed in FIG. 4, a small portion of the vane extends radially outward of the outside surface 110 of the shaft 82, so that the axially opposite end faces of the vanes have contact with the end bearings 88 and 90 even when the vanes are in their most retracted position.

As a result of the projection of the vanes 100–106 radially outward of the shaft 82 even in their most retracted positions, the pump 80 is not as volumetrically efficient as the pump 10 (FIGS. 1 and 2). This is best understood with reference to FIG. 3. Assuming the shaft 82 rotates in the direction of arrow 112, as the shaft rotates from the position illustrated, the pocket between vanes 106 and 102 will contract during the next 90° of revolution of the shaft. Thereafter, the pocket between these two vanes stops communicating with the exhaust port 114 and begins communicating with the inlet port 116. However, there is a volume of fluid, termed the carryover volume, bounded by points labeled A, B, C, and D which in effect is never expelled from the pump, and therefore decreases volumetric efficiency. For a given shaft diameter and liner bore diameter the carryover volume can be reduced by making the shaft which carries the vanes as close to tangent to the liner bore as possible as in the pump illustrated in FIGS. 1 and 2. However, tangency cannot be achieved with a uniform diameter shaft because, if it were, there would be no means for axially positioning the vanes when they are in their most retracted position. Thus the penalty exacted for making pumps stackable has been a reduction in volumetric efficiency.

Figure 5:
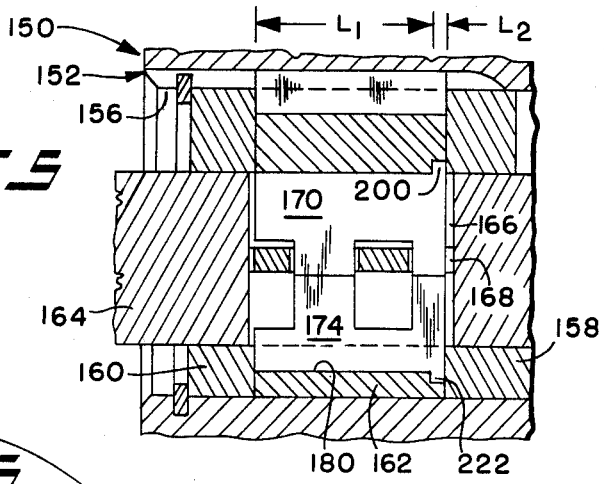
FIG. 5 is a sectional view through a preferred form of pump constructed in accordance with the present invention looking in the direction of arrows 5—5 of FIG. 6.
Figure 6:
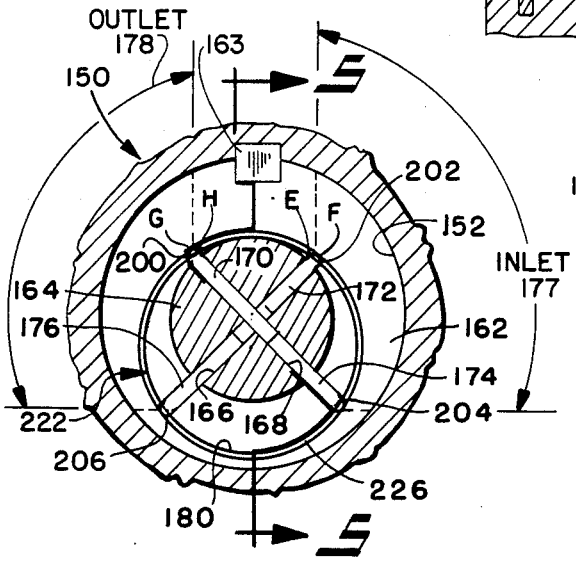
FIG. 6 is a fragmentary transverse sectional view of the pump of FIG. 5.

FIGS. 5 and 6 illustrate an improved pump assembly 150 constructed in accordance with the present invention. The pump 150 includes a housing 152 having an internal cylindrical bore 156. End bearings 158 and 160 and liner 162 fit snugly within the bore 156. Shaft 164 extends through the end bearings 158 and 160 and has a plurality of mutually perpendicular slots 166 and 168 which carry vanes 170,174, and 172,176.

The liner 162 is held stationary within the housing 152 as by means of a key 163 therebetween (see FIG. 6), and has an internal eccentric bore 180 whose axis is parallel to but eccentric from the axis of the shaft 164. The liner 162 is made so that it is as nearly tangent to the shaft 164 as is practicable. As in prior art pumps, as the shaft 164 rotates, centrifugal force presses the vanes 170–176 radially outward into engagement with the internal bore 180 of the liner 162. The vanes thus define pockets which expand and contract as the shaft 164 rotates. Assuming the shaft rotates in a clockwise direction as shown in FIG. 6, the fluid will enter the pump through the inlet port 177 and will be discharged from the pump through the outlet port 178. Rotation of the shaft in the opposite direction will cause a reverse flow of fluid through the pump.

The slots 166 and 168 have an axial extent which is greater than that of the liner 162 and the vanes 170–176. Each vane 170–176 has the same axial length as the liner 162 and is positioned axially by means of a radially extending tab 200,202,204 and 206, respectively. Tabs 200–206 are located at one axial end of their respective vanes and, as illustrated, have a rectangular profile in elevation. The tab 200 is shown in an enlarged view in FIG. 7 and has a pair of parallel opposite end faces 210 and 212 connected by an axially extending end surface 214. The face 210 is coplanar with the axial end of the vane 170 and engages end face 220 of end bearing 158. The remaining surfaces 212 and 214 of the tab 200 are engaged by a counterbore 222 formed in the liner 162. The counterbore 222 is coaxial with the bore 180 through the liner 162 and provides a cylindrical surface 224 coaxial with the bore 180 and an annular surface 226 perpendicular thereto. The end face 214 of the tab 200 rides against the cylindrical surface 224 while the face 212 of the tab 200 bears against the annular surface 226. The annular surface 226, the cylindrical surface 224, and the portion of the end face 220 together cooperate to define, in effect, a groove in which the tab 200 is trapped axially. Thus the vane 170 as well as the vanes 172–176 are positioned axially within the pump by the counterbore 222 and the end bearing 158.

Figure 9:
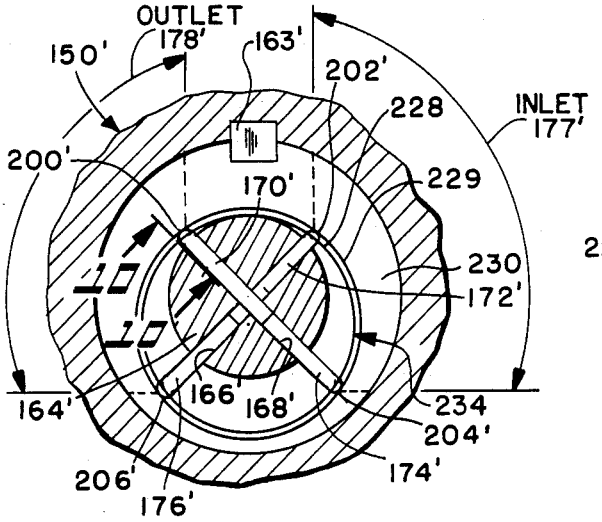
FIG. 9 is a fragmentary transverse sectional view similar to FIG. 5 but showing an alternate form of pump constructed in accordance with this invention.
Figure 10:
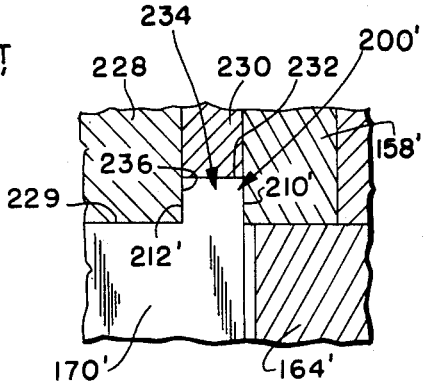
FIG. 10 is an enlarged fragmentary longitudinal section of a portion of the pump of FIG. 9 taken generally along line 10—10 thereof showing an alternate liner/-wafer construction.

Alternatively, instead of providing a counterbore 222 in the end of the liner for receipt of the tabs 200–206, the pump unit 150' may be provided with a liner 228 having a uniform diameter internal bore 229 throughout its entire length, and a separate wafer 230 adjacent one end of the liner 228 having an internal bore 232 of a greater diameter than the internal diameter of the liner bore 229 to form a groove 234 between the opposite end faces 210' and 236 of the bearing 158' and liner 228 for receipt of the vane tabs 200'–206' as in the alternate pump design shown in the FIGS. 9 and 10 embodiment. The liner 228 (and wafer 230) are keyed against rotation within the housing as by means of a key 163' therebetween (see FIG. 9). This construction eliminates the costly counterbore in the liner and permits the vane tabs and wafer to be axially controlled for better volumetric efficiency. Otherwise, the details of construction and operation of the single pump unit 150' shown in FIGS. 9 and 10 are substantially the same as that shown in FIGS. 5 and 6. Accordingly, the same reference numerals followed by a prime symbol are used to designate like parts.

Both the axial and radial extent of the tabs 200–206 and 200'–206' are selected to be the minimum size necessary. Specifically, the radial extent, i.e., the length of surface 212 or 212' of each tab must be long enough that the forces applied to the vane to position it axially are distributed over a large enough area so as not to cause undue wear. For example, the radial extent of each tab may be 1/10 of an inch or less. Similarly, if the vane is in the neighborhood of 1½" long, each tab may be less than 1/10 of that length.

Figure 7:
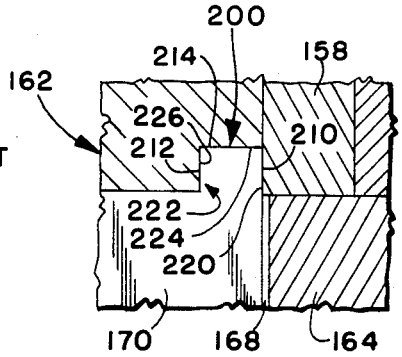
FIG. 7 is an enlarged fragmentary longitudinal section of a portion of the pump of FIG. 5.

It should be noted that the surface 212 or 212' of each tab is in constant or nearly constant contact with the annular surface 226 or 236, and it is this pair of matching surfaces which prevents each vane from moving to the left as viewed in FIG. 7 or FIG. 10. By contrast, contact of the surface 210 or 210' of each tab with the end bearing 158 or 158' prevents movement of the vanes to the right as viewed in FIG. 7 or FIG. 10. However, as the shaft rotates the area of contact between the end bearing 158 or 158' and the righthandmost end face of each vane increases substantially as the vane slides radially outward in the respective slots through the shaft 164 or 164'.

Although the tabs 200–206 or 200'–206' have been shown with a rectangular profile, other shapes are possible. It is only necessary that the tabs, whatever their shape, match the shape of the groove or counterbore 222 in the liner 162 or groove 234 provided by the larger internal diameter bore 232 in the wafer 230 and that the tabs be able to resist axial movement of the vanes by engagement with the annular groove surface 226 or 236 and opposed bearing 158 or 158' surface.

It will be readily appreciated that the volumetric efficiency of the pump 150 is only slightly less than that of the prior art pump 10 and further that the pump 150 is stackable so that multiple pumping units may be assembled on a single shaft 164. Specifically, the shaft 164 may be as nearly tangent to the internal bore 180 in the liner as is practicable over more than 90% of the total axial length of the liner 162 (L1 in FIG. 5). This means that for that fraction of the length of the pump, the volumetric efficiency is at its maximum for a given shaft diameter and internal liner bore diameter. Over a relatively short axial length, i.e. the length of the tab 200 labeled L2 in FIG. 5, the vane extends radially beyond the diameter of the shaft 164 and accordingly there is a relatively small carry-over volume defined by the points labeled E, F, G, and H in FIG. 6 multiplied by the length L2.

Likewise, the volumetric efficiency of the pump 150' is only slightly less than the prior art pump 10 and, like the pump 150, is stackable so that multiple pump units may be assembled on a single shaft 164'.

If only a single pump unit 150 or 150' of the construction shown in FIGS. 5 through 7 or FIGS. 9 and 10 is used, the shaft 164 or 164' must be axially positioned with thrust washers against both bearings 158 and 160 or 158' and 160' and retaining rings.

Figure 8:
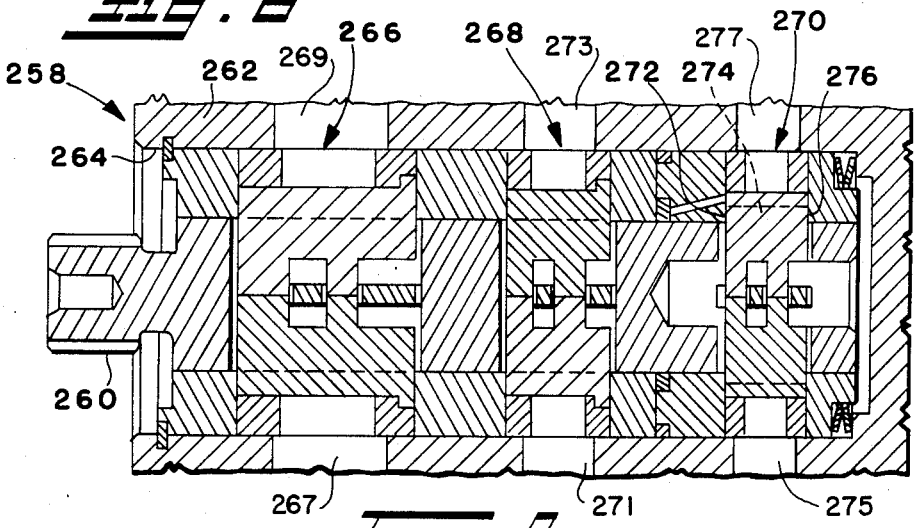
FIG. 8 is a fragmentary longitudinal section of a preferred form of pump assembly constructed in accordance with the present invention including two pump units similar to that illustrated in FIG. 5 and one pump unit similar to that illustrated in FIG. 1, all mounted on a common shaft.

A pump 258 may be constructed with multiple pump units on a single shaft as illustrated in FIG. 8. There a single shaft 260 extends through the housing 262. The housing 262 has a uniform bore 264 formed therein and receives the various pump elements. Specifically, the pump illustrated in FIG. 8 includes two pump assemblies 266 and 268 of the type illustrated in FIGS. 5 and 6 and constructed in accordance with the present invention. Also, a third pump assembly 270 of the type illustrated in FIG. 1 may be provided at one end of the shaft 260. The shaft 260 has a uniform outside diameter through the pump assemblies 266 and 268 and then has a radially outward shoulder 272 followed by an enlarged diameter portion 274 and another shoulder 276 which reduces the diameter of the shaft back down to its original diameter. The stack of two or more pump assemblies (three being shown in FIG. 8) facilitates staging of the pump units so that one pump assembly serially receives its working fluid from another pump assembly. For example, the pump assembly 266 may draw air from the atmosphere, into its inlet 267 compress it and force its output of compressed air from its outlet 269 into the inlet 271 to pump assembly 268; pump assembly 268 further compresses the air and delivers it from its outlet 273 to the inlet 275 of pump assembly 270 for further compression and discharge through its outlet 277; and so on. Alternatively, the pump discharge from each pump assembly may be exhausted to separate sources or combined with the pump discharge of one or more pump assemblies as desired. Such a combination of pump assemblies in a single unit would not be possible with any of the prior art pumps shown in FIGS. 1 through 4 at the level of efficiency achieved by the pump illustrated in FIG. 8.

The present invention provides a vane pump (or motor) 150 (FIG. 5) which can be constructed with multiple units on a single shaft (FIG. 8) and which has near maximum volumetric efficiency. To these ends the shaft 164 (FIG. 5) is formed with a uniform diameter and is mounted as near to tangent to the liner bore 180 as is practicable. Axial positioning of the vanes 170–176 is accomplished by providing each vane with a radially extending tab 200–206, respectively, at one axial end thereof. The tab, e.g. 200 (FIG. 7) fits in an annular groove formed by counterbore 224 in the bearing liner 162 and an end face 220 of end bearing 158. This arrangement permits the shaft 164 to have a uniform diameter and to be mounted as nearly tangent to the bore in the liner 162 as practicable while still allowing total control of the axial position of the vane.

Figure 11:
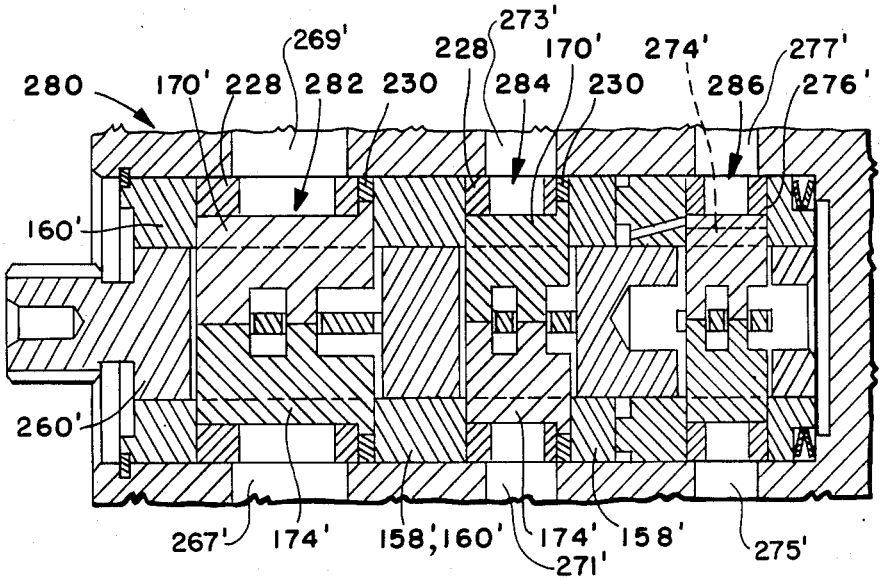
FIG. 11 is a fragmentary longitudinal section of an alternate form of pump assembly constructed in accordance with this invention showing the alternate liner/-wafer construction included in two pump units similar to that illustrated in FIG. 10 and one pump unit similar to that in FIG. 1, all mounted on a common shaft.

FIG. 11 shows another multiple pump unit 280 in accordance with this invention including multiple pump units on a single shaft similar to that illustrated in FIG. 8. However, the pump 280 includes two pump units 282 and 284 having the alternate liner/wafer construction illustrated in FIGS. 9 and 10 and one pump unit 286 similar to that illustrated in FIG. 1, all mounted on a common shaft 260'. The individual wafers 230 may be stacked and "gang" bored to the desired finished configuration. Otherwise, the details of construction and operation of the multiple pump unit 280 shown in FIG. 11 are substantially the same as that shown and described in connection with the FIG. 8 embodiment.

Although the invention has been described with reference to a liner having a cylindrical bore and a pump with a single inlet and a single outlet port, the invention can also be applied to liners with non-circular bores and plural inlet and outlet ports.

Although the invention has been shown and described with respect to certain preferred embodiments, it is obvious that equivalent alterations and modifications will occur to others skilled in the art upon the reading and understanding of the specification. The present invention includes all such equivalent alterations and modifications and is limited only by the scope of the claims.

What is claimed is:

1. A pump assembly comprising a housing, a shaft mounted for rotation within said housing, a plurality of axially spaced pump units mounted on said shaft, each said pump unit including a cavity in said housing having an axis parallel to and offset from the axis of said shaft, a pair of end bearings defining opposite end faces of said cavity, said shaft carrying a plurality of radially slidable vanes engaging the wall of said cavity and defining pumping pockets as said shaft rotates, and positioning means for positioning said vanes axially in said cavity, said shaft having a uniform diameter at least through one of said cavities and associated end bearings, and said positioning means including wall means defining a circumferential groove extending radially outwardly of said one cavity, and tab means extending radially outward from each vane associated with said one cavity, said tab means being disposed in sliding sealing engagement within said groove.

2. The pump assembly of claim 1 wherein said one cavity is cylindrical, and said shaft is eccentrically mounted with respect to said one cavity.

3. The pump assembly of claim 1 wherein said groove and tab means have a relatively small axial length compared to the overall axial length of said one cavity and associated vanes.

4. The pump assembly of claim 1 wherein said groove and tab means have a radial length which is relatively small compared to the radial dimensions of said one cavity and associated vanes.

5. The pump assembly of claim 1 wherein said housing includes a liner having said one cavity therein, and said wall means includes a wafer adjacent one end of said liner, said wafer having an internal bore of a greater diameter than the internal diameter of said liner to define said groove adjacent said one end of said liner.

6. The pump assembly of claim 5 wherein said wall means is also formed by an end face of said liner at said one end of said liner and one of said end bearings, said wafer being disposed between said end face and said one end bearing.

7. The pump assembly of claim 1 wherein said shaft is mounted substantially tangent to the wall of said one cavity.

8. The pump assembly of claim 7 wherein said housing includes a liner having said one cavity therein, and said groove is formed in said liner.

9. The pump assembly of claim 8 wherein said groove includes a counterbore at one end of said liner.

10. The pump assembly of claim 8 wherein said wall means includes a portion of one of said end bearings.

11. The pump assembly of claim 8 wherein said counterbore includes a face perpendicular to the axis of said shaft and another face parallel to the axis of said shaft.

12. A pump assembly comprising a housing, a shaft mounted for rotation within said housing, a plurality of axially spaced pump units mounted on said shaft, each said pump unit including a liner in said housing having a bore with an axis parallel to and offset from the axis of said shaft, end bearings adjacent opposite ends of said liner, a set of vanes mounted in and radially slidable with respect to said shaft, said vanes engaging the bore through said liner, and positioning means for axially positioning said vanes with respect to said liner, said positioning means including a circumferential groove adjacent the end of at least one of said liners and a tab extending radially from each of the vanes associated with said one of said liners, said tabs extending into said groove.

13. The pump assembly of claim 12 wherein said positioning means includes a circumferential groove formed adjacent one end of a plurality of said liners, and a tab extending radially from each of the vanes associated with said plurality of liners and into said grooves.

14. The pump assembly of claim 12 wherein said shaft has an enlarged diameter portion adjacent one end which defines a pair of axially spaced shoulders adjacent opposite ends of said enlarged diameter portion, the liner of one of said pump units surrounds said enlarged diameter portion, the set of vanes of said one pump unit is mounted in and radially slidable with respect to said enlarged diameter portion, and the associated end bearings of said one pump unit engage opposite ends of the associated liner of said one pump unit and said axially spaced shoulders for axial retention of said set of vanes of said one pump unit therebetween.

15. The pump assembly of claim 12 wherein said groove is formed by providing a wafer adjacent one end of one of said liners, said wafer having an internal diameter greater than the internal diameter of said one of said liners.

16. The pump assembly of claim 15 wherein said groove is also formed by said one end of said one liner and one of said end bearings which extend radially inwardly of the internal diameter of said wafer.

17. A pump assembly comprising a housing, a shaft mounted for rotation within said housing, a plurality of axially spaced pump units mounted on said shaft, each said pump unit including a liner in said housing having a bore with an axis parallel to and offset from the axis of said shaft, end bearings engaging opposite ends of said liners, a set of vanes mounted in and radially slidable with respect to said shaft, said vanes engaging said bore through said liner, and positioning means for axially positioning said vanes with respect to said liner, said positioning means including a circumferential groove formed in at least one of said liners and a tab extending radially from each of the vanes associated with said one of said liners, said tabs extending into said groove.

18. The pump assembly of claim 16 wherein said shaft has an enlarged diameter portion adjacent one end which defines a pair of axially spaced shoulders adjacent opposite ends of said enlarged diameter portion, the liner of one of said pump units surrounds said enlarged diameter portion, the set of vanes of said one pump unit is mounted in and radially slidable with respect to said enlarged diameter portion, and the associated end bearings of said one pump unit engage opposite ends of the associated liner of said one pump unit and said axially spaced shoulders for axial retention of said set of vanes of said one pump unit therebetween.

19. The pump assembly of claim 17 wherein said groove is formed by a counterbore in one end of said one of said liners.

20. The pump assembly of claim 17 wherein one of said end bearings is coaxially spaced from the axial outer end of said counterbore.

21. The pump assembly of claim 17 wherein said positioning means includes a circumferential groove formed in a plurality of said liners, and a tab extending radially from each of the vanes associated with said plurality of liners and into said grooves.

22. The pump assembly of claim 20 wherein said shaft has a uniform diameter through at least two of said liners and associated end bearings.

23. The pump assembly of claim 22 wherein said shaft is mounted substantially tangent to the bore of at least two of said liners.

24. The pump assembly of claim 22 further comprising another pump unit mounted on an enlarged diameter portion of said shaft adjacent one end of said shaft, said enlarged diameter portion defining a pair of axially spaced shoulders adjacent opposite ends of said enlarged diameter portion, said another pump unit comprising another liner within said housing surrounding said enlarged diameter portion, said another liner having a bore with an axis parallel to and offset from the axis of said shaft, another set of vanes mounted in and radially slidable with respect to said enlarged diameter portion, and additional end bearings engaging opposite ends of said another liner and said axially spaced shoulders for retention of said another set of vanes therebetween.

25. A rotary vane pump comprising a housing containing a liner having a cavity therein, a shaft mounted for rotation about an axis parallel to and offset from the axis of said cavity, a pair of end bearings defining opposite end faces of said cavity, said shaft having a uniform diameter at least through said end bearings and cavity, said shaft carrying a plurality of radially slidable vanes engaging the wall of said cavity and defining pumping pockets as said shaft rotates, and positioning means for positioning said vanes axially in said cavity including wall means defining a circumferential groove, and a tab extending radially outward from each vane, said tabs being disposed in sliding sealing engagement within said groove, said end bearings engaging opposite ends of said liner for axially locating said liner on said shaft, and said wall means including a counterbore in one end of said liner, said tabs extending radially outwardly into said counterbore.

26. The pump of claim 15 wherein said wall means is also defined by one of said end bearings which engages said liner at the axial outer end of said counterbore.

27. A rotary vane pump comprising a housing containing a liner having a cavity therein, a shaft mounted for rotation about an axis parallel to and offset from the axis of said cavity, a pair of end bearings defining opposite end faces of said cavity, said shaft having a uniform diameter at least through said end bearings and cavity, said shaft carrying a plurality of radially slidable vanes engaging the wall of said cavity and defining pumping pockets as said shaft rotates, and positioning means for positioning said vanes axially in said cavity including wall means defining a circumferential groove, and a tab extending radially outward from each vane, said tabs being disposed in sliding sealing engagement within said groove, and said wall means including a wafer adjacent one end of said liner, said wafer having an internal bore of a greater diameter than said cavity to define said groove adjacent said one end of said liner, said tabs extending radially outwardly into said groove.

28. The pump of claim 27 wherein said wall means also includes opposed end faces of said liner and one of said end bearings, said wafer being disposed between said opposed end faces, said opposed end faces extending radially inwardly of the internal diameter of said wafer.

* * * * *